US010224043B2

(12) United States Patent
Setiawan et al.

(10) Patent No.: US 10,224,043 B2
(45) Date of Patent: Mar. 5, 2019

(54) AUDIO SIGNAL PROCESSING APPARATUSES AND METHODS

(71) Applicant: Huawei Technologies Co., Ltd., Shenzhen (CN)

(72) Inventors: Panji Setiawan, Munich (DE); Karim Helwani, Munich (DE)

(73) Assignee: Huawei Technologies Co., Ltd, Shenzhen (CN)

( * ) Notice: Subject to any disclaimer, the term of this patent is extended or adjusted under 35 U.S.C. 154(b) by 0 days.

(21) Appl. No.: 15/714,465

(22) Filed: Sep. 25, 2017

(65) Prior Publication Data

US 2018/0012607 A1 Jan. 11, 2018

Related U.S. Application Data

(63) Continuation of application No. PCT/EP2015/059477, filed on Apr. 30, 2015.

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01); *H04S 2400/01* (2013.01); *H04S 2400/03* (2013.01)

(58) Field of Classification Search
None
See application file for complete search history.

(56) References Cited

U.S. PATENT DOCUMENTS

2012/0207325 A1 8/2012 Taenzer
2012/0269353 A1 10/2012 Herre et al.
(Continued)

FOREIGN PATENT DOCUMENTS

CN 103548077 A 1/2014
CN 104160442 A 11/2014
(Continued)

OTHER PUBLICATIONS

Briand, M. et al., "Parametric Coding of Stereo Audio Based on Principal Component Analysis," Proc. of the 9th Int. Conference on Digital Audio Effects (DAFx-06), Montreal, Canada, Sep. 18-20, 2006, pp. 291-296.
(Continued)

*Primary Examiner* — Curtis A Kuntz
*Assistant Examiner* — Qin Zhu
(74) *Attorney, Agent, or Firm* — Slater Matsil, LLP

(57) ABSTRACT

Audio signal processing apparatuses and methods are provided, such as an audio signal downmixing apparatus for processing an input audio signal into an output audio signal, wherein the input audio signal comprises a plurality of input channels recorded at a plurality of spatial positions and the output audio signal comprises a plurality of primary output channels. The audio signal downmixing apparatus comprises a downmix matrix determiner configured to determine for each frequency bin j of a plurality of frequency bins a downmix matrix $D_U$ with j being an integer in the range from 1 to N, and a processor configured to process the input audio signal using the downmix matrix $D_U$ into the output audio signal.

13 Claims, 2 Drawing Sheets

(56) References Cited

U.S. PATENT DOCUMENTS

| | | | | |
|---|---|---|---|---|
| 2012/0288124 | A1* | 11/2012 | Fejzo | H04R 5/02 381/303 |
| 2014/0088978 | A1 | 3/2014 | Mundt et al. | |
| 2016/0019899 | A1 | 1/2016 | Kjoerling et al. | |

FOREIGN PATENT DOCUMENTS

| | | | | |
|---|---|---|---|---|
| EP | 2880654 | B1 * | 9/2017 | G10L 19/008 |
| WO | 2013120510 | A1 | 8/2013 | |

OTHER PUBLICATIONS

Helwani, K. et al., "The Synthesis of Sound Figures," Multidim. Syst. Sign Process (2014), vol. 25, No. 2, Nov. 14, 2013, pp. 379-403.

Hotho, G. et al., "A Backward-Compatible Multichannel Audio Codec," IEEE Transactions on Audio, Speech, and Language Processing, vol. 6, No. 1, Jan. 2008, pp. 83-93.

Yang, E. et al., "High-Fidelity Multichannel Audio Coding With Karhunen-Loève Transform," IEEE Transactions on Speech and Audio Processing, vol. 11, No. 4, Jul. 2003, pp. 365-380.

* cited by examiner

AUDIO SIGNAL PROCESSING APPARATUSES AND METHODS

CROSS-REFERENCE TO RELATED APPLICATIONS

This application is a continuation of International Application No. PCT/EP2015/059477, filed on Apr. 30, 2015, the disclosure of which is hereby incorporated by reference in its entirety.

TECHNICAL FIELD

The present invention relates to audio signal processing apparatuses and methods. In particular, the present invention relates to audio signal processing apparatuses and methods for downmixing and upmixing an audio signal.

BACKGROUND

The art of sound coding, transmission, recording, mixing and reproduction has been a continuous topic of research and development for many decades. Starting from the monophonic technology, technologies on multichannel audio have been gradually extended to include stereophonic, quadrophonic, 5.1 channels and the like. Compared with traditional mono or stereo audio, multichannel audio provides end users with a more compelling listening experience and, thus, becomes more and more appealing to audio producers.

For multichannel audio to be successful it should be possible to reproduce multichannel audio on a legacy playback device supporting only a subset M of an arbitrary number of recording channels Q. The subset of M reproduction channels, for instance, loudspeakers or headphones, in the playback device may change according to the user's need. This may happen when the user switches his device, e.g., from stereo to 5.1 or from stereo to any 3 loudspeaker devices.

The conventional way of reproducing multichannel audio on a legacy playback device is by using a fixed downmix matrix for downmixing the Q channel audio input signal into an audio output signal having only M channels. This can be done at the sender or the receiver side, which is constrained by the popular content format available, such as stereo, 5.1 and 7.1. To date, it is not possible for any playback device to support an arbitrary number of output channels in an optimal and flexible way without prior information regarding the reproduction layout, no feedback to recording device, e.g., plug and play stereo to 3.0, stereo to 8.2, etc.

Thus, there is a need for an improved audio signal processing apparatus and method.

SUMMARY

It is an object of the invention to provide an improved audio signal processing apparatus and method.

This object is achieved by the subject matter of the independent claims. Further implementation forms are provided in the dependent claims, the description and the figures.

According to a first aspect the embodiments of the invention relate to an audio signal downmixing apparatus for processing an input audio signal into an output audio signal, wherein the input audio signal comprises a plurality of input channels recorded at a plurality of spatial positions and the output audio signal comprises a plurality of primary output channels. The audio signal downmixing apparatus comprises a downmix matrix determiner configured to determine for each frequency bin j of a plurality of frequency bins a downmix matrix $D_U$ with j being an integer in the range from 1 to N, wherein for a given frequency bin j the downmix matrix $D_U$ maps a plurality of Fourier coefficients associated with the plurality of input channels of the input audio signal into a plurality of Fourier coefficients of the primary output channels of the output audio signal, wherein for frequency bins with j being smaller than or equal to a cutoff frequency bin k the downmix matrix $D_U$ is determined by determining eigenvectors of the discrete Laplace-Beltrami operator L defined by the plurality of spatial positions where the plurality of input channels are recorded, and wherein for frequency bins with j being larger than the cutoff frequency bin k the downmix matrix $D_U$ is determined by determining a first subset of eigenvectors of a covariance matrix COV defined by the plurality of input channels of the input audio signal, and a processor configured to process the input audio signal using the downmix matrix $D_U$ into the output audio signal. The spatial positions could be defined by the spatial positions of a plurality of microphones.

Thus, an improved and flexible audio signal processing apparatus is provided due to the fact that an optimal downmix matrix is derived in a frequency selective manner taking into account the actual design of acquisition system geometry.

In a first possible implementation form of the audio signal downmixing apparatus according to the first aspect of the invention the downmix matrix determiner is configured to determine the discrete Laplace-Beltrami operator L using the following equations:

$$L=C-W$$

$$C=\mathrm{diag}\{c\}$$

$$c=[c_1, \ldots, c_p, \ldots, c_Q]$$

$$c_p=\Sigma_{q=1}^{Q} w_{pq}$$

where L is a matrix representation of the Laplace-Beltrami operator and C and W are matrices having respective dimensions Q×Q, where Q is the number of input channels, diag ( . . . ) denotes a matrix diagonalization operation placing the input vector elements as the diagonal of the output matrix with the rest of matrix elements being zero, c is a vector of dimension Q and wpq are local averaging coefficients.

The first possible implementation form provides a computationally efficient way of computing the discrete Laplace-Beltrami operator L.

In a second possible implementation form of the audio signal downmixing apparatus according to the first implementation form of the first aspect of the invention the downmix matrix determiner is configured to determine the local averaging coefficients $w_{pq}$ using the following equations:

$$w_{pq} = \frac{1}{\|r_q - r_p\|^2};\ p \neq q$$

$$w_{pq} = 0;\ p = q$$

where $r_p$ or $r_q$ is a vector defining a spatial position of the plurality of spatial positions where the plurality of input channels of the input audio signal are recorded at.

The second possible implementation form provides a computationally efficient approximation using distance weights for the averaging coefficients $w_{pq}$ on the basis of the 3-dimensional positions $r_p$ and $r_q$ of the respective devices to record the plurality of input channels.

In a third possible implementation form of the first aspect of the invention as such or any one of the first or second implementation form thereof, the downmix matrix $D_U$ is determined for frequency bins with j being smaller than or equal to the cutoff frequency bin k by selecting the eigenvectors of the discrete Laplace-Beltrami operator L that have an eigenvalue that is greater than a predefined threshold.

The third possible implementation form provides a computationally efficient way of selecting the optimal eigenvectors of the Laplace-Beltrami operator L for the downmix matrix $D_U$.

In a fourth possible implementation form of the first aspect of the invention as such or any one of the first to third implementation form thereof, the downmix matrix $D_U$ is determined for frequency bins with j being larger than the cutoff frequency bin k by selecting the eigenvectors of the covariance matrix COV that have an eigenvalue that is greater than a predefined threshold.

The fourth possible implementation form provides a computationally efficient way of selecting the optimal eigenvectors of the covariance matrix COV for the downmix matrix $D_U$.

In a fifth possible implementation form of the first aspect of the invention as such or any one of the first to fourth implementation form thereof, the downmix matrix determiner is configured to determine the cutoff frequency bin k by determining the frequency bin of the plurality of frequency bins which has the smallest compactness measure $\Theta_C$ of all frequency bins having a compactness measure $\Theta_C$ greater than a predefined threshold T, wherein the compactness measure $\Theta_C$ of a frequency bin is determined using the following equation:

$$\theta_C = \frac{\|\mathrm{diag}(\hat{U}^H \mathrm{COV} \hat{U})\|_F}{\|\mathrm{off}(\hat{U}^H \mathrm{COV} \hat{U})\|_F}$$

wherein $\hat{U}$ denotes a unitary matrix containing the selected eigenvectors of the discrete Laplace-Beltrami operator L, $\hat{U}^H$ denotes the hermitian transpose of $\hat{U}$, diag ( . . . ) denotes a matrix diagonalization operation zeroing all coefficients except the coefficients along the diagonal of the matrix given a matrix input, off ( . . . ) denotes a matrix operation zeroing all coefficients on the diagonal of the matrix and $\| \ldots \|_F$ denotes the Frobenius norm.

The fifth possible implementation form provides a computationally efficient implementation for determining the cutoff frequency bin k by using the compactness measure $\Theta_C$. As the person skilled in the art will appreciate, the cutoff frequency bin k could be determined to be the largest frequency bin N so that, in this case, the downmix matrix $D_U$ is solely determined by the eigenvectors of the discrete Laplace-Beltrami operator L.

In a sixth possible implementation form of the first aspect of the invention as such or any one of the first to fifth implementation form thereof, the audio signal downmixing apparatus further comprises a downmix matrix extension determiner configured to determine a downmix matrix extension $D_W$ by determining a second subset of eigenvectors of the covariance matrix COV containing at least one eigenvector of the covariance matrix COV for providing at least one auxiliary output channel of the output audio signal, wherein the first subset of eigenvectors of the covariance matrix COV and the second subset of eigenvectors of the covariance matrix COV are disjoint sets and wherein the downmix matrix $D_U$ and the downmix matrix extension $D_W$ define an extended downmix matrix D.

In a seventh possible implementation form of the sixth implementation form of the first aspect of the invention, the downmix matrix extension determiner is configured to determine the second subset of eigenvectors of the covariance matrix COV by determining for each eigenvector of the covariance matrix COV a plurality of angles between the eigenvector and a plurality of vectors defined by the columns of the downmix matrix $D_U$, determining for each eigenvector the smallest angle of the plurality of angles between the eigenvector and the plurality of vectors defined by the columns of the downmix matrix $D_U$ and selecting those eigenvectors of the covariance matrix COV for which the smallest angle between the eigenvector and the plurality of vectors defined by the columns of the downmix matrix $D_U$ is bigger than a threshold angle $\Theta_{MIN}$.

The seventh possible implementation form provides a computationally efficient way of deriving the downmix matrix extension $D_W$ using further eigenvectors of the covariance matrix COV.

In an eighth possible implementation form of the first aspect of the invention as such or any one of the first to seventh implementation form thereof, the processor is configured to process the input audio signal for each of the plurality of input channels in form of a plurality of input audio signal time frames and wherein the plurality of Fourier coefficients associated with the plurality of input channels of the input audio signal are obtained by discrete Fourier transforms of the plurality of input audio signal time frames.

The eighth possible implementation form provides for a computationally efficient processing of the input channels of the input audio signal in a frame-wise manner using a discrete Fourier transformation, in particular a FFT. The audio signal time frames can be overlapping.

In a ninth possible implementation form of the eighth implementation form of the first aspect of the invention, the downmix matrix determiner is configured to determine the covariance matrix COV defined by the plurality of input channels of the input audio signal by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=E\{j_x \cdot j^*_y\}$$

where E{ } denotes an expectation operator, $j_x$ denotes a Fourier coefficient at frequency bin j for input channel x of the input audio signal, * denotes the complex conjugate and x and y range from 1 to the number of input channels Q.

The ninth possible implementation form provides for a computationally efficient way of determining the covariance matrix COV.

In a tenth possible implementation form of the eighth implementation form of the first aspect of the invention, the downmix matrix determiner is configured to determine the covariance matrix COV defined by the plurality of input channels of the input audio signal by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=\beta \cdot c_{xy}(n-1,j)+(1-\beta) \cdot \hat{c}_{xy}(n,j)$$

where β denotes a forgetting factor with $0 \leq \beta < 1$, $\hat{c}_{xy}(n,j)$ denotes the real part of $E\{j_x \cdot j^*_y\}$, $j_x$ denotes a Fourier coefficient at frequency bin j for input channel x of the input audio signal, * denotes the complex conjugate and x and y range from 1 to the number of input channels Q.

According to a second aspect the embodiments of the invention relate to an audio signal downmixing method for processing an input audio signal into an output audio signal, wherein the input audio signal comprises a plurality of input channels recorded at a plurality of spatial positions and the output audio signal comprises a plurality of primary output channels. The method comprises the steps of: determining for each frequency bin j of a plurality of frequency bins a downmix matrix $D_U$ with j being an integer in the range from 1 to N, wherein for a given frequency bin j the downmix matrix $D_U$ maps a plurality of Fourier coefficients associated with the plurality of input channels of the input audio signal into a plurality of Fourier coefficients of the primary output channels of the output audio signal, wherein for frequency bins with j being smaller than or equal to a cutoff frequency bin k the downmix matrix $D_U$ is determined by determining eigenvectors of the discrete Laplace-Beltrami operator L defined by the plurality of spatial positions where the plurality of input channels are recorded, and wherein for frequency bins with j being larger than the cutoff frequency bin k the downmix matrix $D_U$ is determined by determining a first subset of eigenvectors of a covariance matrix COV defined by the plurality of input channels of the input audio signal; and processing the input audio signal using the downmix matrix $D_U$ into the output audio signal.

The audio signal downmixing method according to the second aspect of the invention can be performed by the audio signal downmixing apparatus according to the first aspect of the invention. Further features of the audio signal downmixing method according to the second aspect of the invention result directly from the functionality of the audio signal downmixing apparatus according to the first aspect of the invention and its different implementation forms.

According to a third aspect the embodiments of the invention relate to an encoding apparatus, comprising the audio signal downmixing apparatus according to the first aspect of the invention, and an encoder A configured to encode the plurality of primary output channels of the output audio signal for obtaining a plurality of encoded primary output channels in the form of a first bit stream.

According to a fourth aspect the embodiments of the invention relate to an audio signal upmixing apparatus for processing an input audio signal into an output audio signal, wherein the input audio signal comprises a plurality of primary input channels based on a plurality of input channels recorded at a plurality of spatial positions and the output audio signal comprises a plurality of output channels. The audio signal upmixing apparatus comprises: an upmix matrix determiner configured to determine for each frequency bin j of a plurality of frequency bins an upmix matrix with j being an integer in the range from 1 to N, wherein for a given frequency bin j the upmix matrix maps a plurality of Fourier coefficients associated with the plurality of primary input channels of the input audio signal into a plurality of Fourier coefficients of the output channels of the output audio signal, wherein for frequency bins with j being smaller than or equal to a cutoff frequency bin k the upmix matrix is determined by determining eigenvectors of the discrete Laplace-Beltrami operator L defined by the plurality of spatial positions where the plurality of input channels are recorded, and wherein for frequency bins with j being larger than the cutoff frequency bin k the upmix matrix is determined by determining a first subset of eigenvectors of a covariance matrix COV defined by the plurality of input channels of the input audio signal; and a processor configured to process the input audio signal using the upmix matrix into the output audio signal.

According to a fifth aspect the embodiments of the invention relate to an audio signal upmixing method for processing an input audio signal into an output audio signal, wherein the input audio signal comprises a plurality of primary input channels based on a plurality of input channels recorded at a plurality of spatial positions and the output audio signal comprises a plurality of output channels. The method comprises the steps of: determining for each frequency bin j of a plurality of frequency bins an upmix matrix with j being an integer in the range from 1 to N, wherein for a given frequency bin j the upmix matrix maps a plurality of Fourier coefficients associated with the plurality of primary input channels of the input audio signal into a plurality of Fourier coefficients of the output channels of the output audio signal, wherein for frequency bins with j being smaller than or equal to a cutoff frequency bin k the upmix matrix is determined by determining eigenvectors of the discrete Laplace-Beltrami operator (L) defined by the plurality of spatial positions where the plurality of input channels are recorded, and wherein for frequency bins with j being larger than the cutoff frequency bin k the upmix matrix is determined by determining a first subset of eigenvectors of a covariance matrix COV defined by the plurality of input channels of the input audio signal; and processing the input audio signal using the upmix matrix into the output audio signal.

The audio signal upmixing method according to the fifth aspect of the invention can be performed by the audio signal upmixing apparatus according to the fourth aspect of the invention. Further features of the audio signal upmixing method according to the fifth aspect of the invention result directly from the functionality of the audio signal upmixing apparatus according to the fourth aspect of the invention.

According to a sixth aspect the invention relates to a decoding apparatus comprising an audio signal upmixing apparatus according to the fourth aspect of the invention and a decoder A configured to receive a first bit stream from an encoding apparatus according to the third aspect of the invention, and to decode the first bit stream to obtain a plurality of primary input channels to be processed by the audio signal upmixing apparatus.

According to a seventh aspect the invention relates to an audio signal processing system, comprising an encoding apparatus according to the third aspect of the invention and a decoding apparatus according to the sixth aspect of the invention, wherein the encoding apparatus is configured to communicate at least temporarily with the decoding apparatus.

According to an eighth aspect the invention relates to a computer program comprising a program code for performing an audio signal downmixing method according to the second aspect of the invention and/or an audio signal upmixing method according to the fifth aspect of the invention when executed on a computer.

The invention can be implemented in hardware and/or software.

BRIEF DESCRIPTION OF THE DRAWINGS

Further embodiments of the invention will be described with respect to the following figures, in which.

DETAILED DESCRIPTION OF ILLUSTRATIVE EMBODIMENTS

In the following detailed description, reference is made to the accompanying drawings, which form a part of the disclosure, and in which are shown, by way of illustration, specific aspects in which the disclosure may be practiced. It is understood that other aspects may be utilized and structural or logical changes may be made without departing from the scope of the present disclosure. The following detailed description, therefore, is not to be taken in a limiting sense, and the scope of the present disclosure is defined by the appended claims.

It is understood that a disclosure in connection with a described method may also hold true for a corresponding device or system configured to perform the method and vice versa. For example, if a specific method step is described, a corresponding device or apparatus may include a unit to perform the described method step, even if such unit is not explicitly described or illustrated in the figures. Further, it is understood that the features of the various exemplary aspects described herein may be combined with each other, unless specifically noted otherwise.

Figure 1:
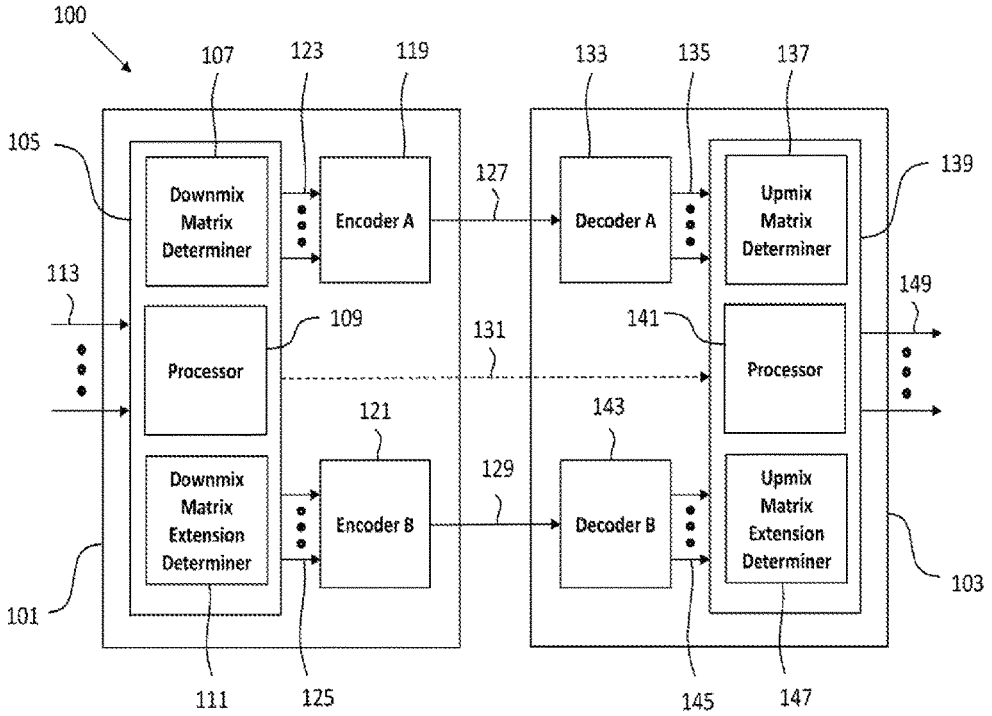
FIG. 1 shows a schematic diagram of an audio signal downmixing apparatus according to an embodiment and an audio signal upmixing apparatus according to an embodiment as part of an audio signal processing system.

FIG. 1 shows a schematic diagram of an audio signal downmixing apparatus 105 according to an embodiment as part of an audio signal processing system 100.

The audio signal downmixing apparatus 105 is configured to process an input audio signal into an output audio signal, wherein the input audio signal comprises a plurality of input channels 113 recorded at a plurality of spatial positions and the output audio signal comprises a plurality of primary output channels 123. In an embodiment, the multichannel input audio signal 113 comprises Q input channels. In an embodiment, the audio signal downmixing apparatus 105 is configured to process the multichannel input audio signal 113 in a frame-wise manner, i.e. in the form of a plurality of input audio signal time frames, wherein an audio signal time frame can have a length of, for instance, about 10 to 40 ms per channel. In an embodiment, subsequent input audio signal time frames can be partially overlapping. In an embodiment, the multichannel input audio signal 113 is processed in the frequency domain. In an embodiment, an input audio signal time frame of a channel of the multichannel input audio signal 113 is transformed into the frequency domain by means of a discrete Fourier transformation, in particular a FFT, yielding a plurality of Fourier coefficients $j_x$ at frequency bin j of the input channel x of the multichannel audio input signal 113, wherein j runs from 1 to N, i.e. the total number of frequency bins, and x runs from 1 to the total number of input channels Q.

The audio signal downmixing apparatus 105 comprises a downmix matrix determiner 107 configured to determine for each frequency bin j (and in case of a frame-wise processing of the multichannel input audio signal 113 for every input audio signal time frame) a downmix matrix $D_U$, wherein for a given frequency bin j the downmix matrix $D_U$ maps the plurality of Fourier coefficients associated with the plurality of input channels 113 of the input audio signal into a plurality of Fourier coefficients of the primary output channels 123 of the output audio signal.

Moreover, the audio signal downmixing apparatus 105 comprises a processor 109 configured to process the multichannel input audio signal 113 using the downmix matrix $D_U$ into the output audio signal.

For frequency bins with j being smaller than or equal to a cutoff frequency bin k the downmix matrix $D_U$ is determined by the downmix matrix determiner 107 by determining eigenvectors of the discrete Laplace-Beltrami operator L defined by the plurality of spatial positions where the plurality of input channels 113 are or have been recorded at. In an embodiment, the plurality of spatial positions where the plurality of input channels 113 are or have been recorded at are defined by the spatial positions of a corresponding plurality of microphones or other sound recording devices used to record the multichannel audio input signal 113. In an embodiment, information about the plurality of spatial positions where the plurality of input channels 113 have been recorded at can be provided to or stored in the downmix matrix determiner 107.

In an embodiment, the downmix matrix determiner 107 is configured to determine the discrete Laplace-Beltrami operator L using the following equations:

$$L=C-W,$$

$$C=\mathrm{diag}\{c\},$$

$$c=[c_1, \ldots, c_p, \ldots, c_Q], \text{ and}$$

$$c_p=\Sigma_{q=1}^{Q} w_{pq},$$

where L is a matrix representation of the Laplace-Beltrami operator and C and W are matrices having respective dimensions Q×Q, where Q is the number of input channels 113, diag ( . . . ) denotes a matrix diagonalization operation placing the input vector elements as the diagonal of the output matrix with the rest of matrix elements being zero, c is a vector of dimension Q and $w_{pq}$ are local averaging coefficients.

In an embodiment, the downmix matrix determiner 107 is configured to determine the local averaging coefficients $w_{pq}$ using the following equations:

$$w_{pq} = \frac{1}{\|r_q - r_p\|^2};\ p \neq q$$

$$w_{pq} = 0;\ p = q,$$

where $r_p$ or $r_q$ is a 3-dimensional vector defining a spatial position of the plurality of spatial positions where the plurality of input channels of the input audio signal are recorded at, for instance, the spatial positions of Q microphones or other sound recording devices used to record the multichannel audio input signal 113.

In an embodiment, the downmix matrix determiner 107 is configured to determine the downmix matrix $D_U$ for frequency bins with j being smaller than or equal to the cutoff frequency bin k by selecting the eigenvectors of the discrete Laplace-Beltrami operator L that have an eigenvalue that is greater than a predefined threshold value $\lambda_L$.

For frequency bins with j being larger than the cutoff frequency bin k the downmix matrix determiner 107 is configured to determine the downmix matrix $D_U$ by determining a first subset of eigenvectors of a covariance matrix COV defined by the plurality of input channels 113 of the input audio signal.

In an embodiment where the multichannel audio input signal 113 is processed in a frame-wise manner, the downmix matrix determiner 107 is configured to determine the covariance matrix COV defined by the plurality of input channels 113 of the input audio signal by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=E\{j_x j^*_y\},$$

where E{ } denotes an expectation operator, * denotes the complex conjugate and x and y range from 1 to the number of input channels Q.

In an embodiment where the multichannel audio input signal 113 is processed in a frame-wise manner, the downmix matrix determiner 107 is configured to determine the covariance matrix COV defined by the plurality of input channels 113 of the input audio signal by determining the coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=\beta\cdot c_{xy}(n-1,j)+(1-\beta)\cdot\hat{c}_{xy}(n,j),$$

where β denotes a forgetting factor with $0\leq\beta<1$ and $\hat{c}_{xy}(n,j)$ denotes the real part of $E\{j_x\cdot j^*_y\}$.

In an embodiment, in order to reduce the computational complexity the Fourier coefficients can be grouped into B different bands based on certain psychoacoustical scales, such as the Bark scale or the Mel scale, and the determination of the covariance matrix COV can be performed per band b, where b ranges from 1 to B. In this case, a simplified covariance matrix can be used having the following coefficients by performing, e.g., an addition:

$$\bar{c}_{xy,b}(n,j)=\sum_{j\in b} c_{xy}(n,j).$$

This grouping into B bands reduces the computational complexity by only taking a subset of the overall Fourier coefficients.

In an embodiment, the downmix matrix determiner 107 is configured to determine the downmix matrix $D_U$ for frequency bins with j being larger than the cutoff frequency bin k by selecting as a first subset of eigenvectors those eigenvectors of the covariance matrix COV that have an eigenvalue that is greater than a predefined threshold value $\lambda_{COV}$.

In an embodiment, the downmix matrix determiner 107 is configured to determine eigenvectors of the covariance matrix COV for a given input audio signal time frame n of the plurality of input audio signal time frames and for a given frequency bin j of the plurality of frequency bins by means of an eigenvalue decomposition (EVD), i.e.

$$\mathrm{COV}(n,j)=U\Lambda U^H,$$

where U is a unitary matrix containing the eigenvectors, Λ is a diagonal matrix containing the eigenvalues and $U^H$ is the Hermitian transpose of the matrix U.

In an embodiment, the eigenvectors of the covariance matrix COV are calculated iteratively by exploiting the rank-one modification character of the covariance matrix estimate to reduce the computational complexity, because it is not necessary to perform the EVD for each frame n.

Exploiting the nature of the autocorrelation estimation in the transform domain leads to an efficient Karhunen-Loeve Transform (KLT)

$$\Lambda^{(i)}(n)=\alpha\Lambda^{(i)}(n-1)+(1-\alpha)Y^{(i)N}(n)Y^{(i)}(n),$$

$$Y^{(i)}(n):=X^{(i)}(n)U^{(i)}(n-1).$$

where α is a forgetting factor having a value between 0 and 1 and Y and X denote the output and input Fourier coefficients arranged as row vectors of the downmix operation performed by the matrix U.

The estimation is based on a rank-one modification of a diagonal matrix. It has been shown in the literature that the eigenvalues of $\Lambda^{(i)}(n)$ are the zeros of the function $$w(\lambda):=1+(1-\alpha)\cdot\sum_{q=1}^{Q}\frac{y_q^2}{\alpha\lambda_q^{(i)}(n-1)-\lambda},$$

$$w(\lambda)=0 \text{ for}$$

$$\lambda\in\{\lambda_q^{(i)}(n)\mid\lambda_q^{(i)}(n) \text{ is an eigen value of the modified matrix } \Lambda^{(i)}(n)\}$$

The zeros of the function w(λ) can be found iteratively. However, the convergence of the search process is quadratic. Once the eigenvalues are computed, the eigenvectors of the modified spatio-temporal transformed autocorrelation matrix $G_{Uq}$ of $\Lambda^{(i)}(n)$ can be explicitly computed by means of the following equations:

$$G_{U_q}=\frac{Y^{(i)}(n)\Lambda_q^{(i)-1}(n)}{\left\|Y^{(i)}(n)\Lambda_q^{(i)-1}(n)\right\|},$$

$$\Lambda_q^{(i)}(n):=\Lambda_q^{(i)}(n-1)-\lambda_q^{(i)}(n)\cdot I_{M\times M}$$

In an embodiment, the downmix matrix determiner 107 is configured to determine the cutoff frequency bin k by determining the frequency bin of the plurality of frequency bins which has the smallest compactness measure $\Theta_C$ of all frequency bins having a compactness measure $\Theta_C$ greater than a predefined threshold T, wherein the compactness measure $\Theta_C$ of a frequency bin is defined by the following equation:

$$\theta_C=\frac{\left\|\mathrm{diag}(\hat{U}^H\mathrm{COV}\hat{U})\right\|_F}{\left\|\mathrm{off}(\hat{U}^H\mathrm{COV}\hat{U})\right\|_F},$$

wherein Û denotes a unitary matrix containing the selected eigenvectors of the discrete Laplace-Beltrami operator L, $\hat{U}^H$ denotes the hermitian transpose of Û, diag ( . . . ) denotes a matrix diagonalization operation zeroing all coefficients except the coefficients along the diagonal of the matrix given a matrix input, off ( . . . ) denotes a matrix operation zeroing all coefficients on the diagonal of the matrix and $\|\ldots\|_F$ denotes the Frobenius norm. For the sake of simplicity the indexes n and j have been omitted in the above equation defining the compactness measure $\Theta_C$ of a frequency bin. As j goes from lower to higher frequencies (j=1 to N), the compactness measure $\Theta_C$ gets smaller. The choice of the cutoff frequency bin k is then determined heuristically using the predefined threshold T, where listening tests can be taken into account to make sure, that perceptually lossless encoding is possible.

The embodiments of the present invention includes embodiments where the cutoff frequency bin k is equal to the frequency bin corresponding to the highest frequency. As the person in the art will appreciate, in such a case the downmix matrix $D_U$ is solely defined by the eigenvectors of the discrete Laplace-Beltrami operator L for all frequency bins.

In an embodiment, the audio signal downmixing apparatus 105 further comprises a downmix matrix extension determiner 111 configured to determine a downmix matrix extension $D_W$ by determining a second subset of eigenvectors of the covariance matrix COV containing at least one eigenvector of the covariance matrix COV for providing at least one auxiliary output channel 125 of the output audio signal. The first subset of eigenvectors of the covariance matrix COV determined by the downmix matrix determiner 107 and the second subset of eigenvectors of the covariance matrix COV determined by the downmix matrix extension determiner 111 are determined in such a way that the first and second subset of eigenvectors are disjoint sets. The downmix matrix $D_U$ and the downmix matrix extension $D_W$ together define an extended downmix matrix D.

In an embodiment, the downmix matrix extension determiner 111 is configured to determine the second subset of eigenvectors of the covariance matrix COV by means of the following steps. In a first step the downmix matrix determiner 111 determines for each eigenvector of the covariance matrix COV a plurality of angles between the eigenvector and a plurality of vectors defined by the columns of the downmix matrix $D_U$. In a second step the downmix matrix determiner 111 determines for each eigenvector the smallest angle of the plurality of angles between the eigenvector and the plurality of vectors defined by the columns of the downmix matrix $D_U$. In a third step the downmix matrix determiner 111 selects those eigenvectors of the covariance matrix COV for which the smallest angle between the eigenvector and the plurality of vectors defined by the columns of the downmix matrix $D_U$ is bigger than a predefined threshold angle $\Theta_{MIN}$.

The downmix matrix $D_U$ defines a subspace U of the space defined by the extended downmix matrix D. The downmix matrix extension $D_W$ defines a subspace W of the space defined by the extended downmix matrix D. The subspace angle between the subspace U and the subspace W is defined by as the minimum angle between all vectors u spanning the subspace U and all vectors w spanning the subspace W, i.e.

$$\theta_1 := \min\left\{\arccos\left(\frac{|\langle u, w\rangle|}{\|u\|\|w\|}\right) \middle| u \in \mathcal{U}, w \in \mathcal{W}\right\} = \angle(u_1, w_1),$$

where <u,w> denotes the dot product of the vectors u and w and ||u|| denotes the norm of the vector u.

An example is given below for the exemplary case M=2 and Q=4 so that the subspace U is spanned by the vectors u1 and u2, i.e. U ={u1, u2} and the subspace W is spanned by the vectors w1, w2, w3 and w4, i.e. W={w1, w2, w3, w4}. In an embodiment, the following angles are calculated:

$$\theta_1=\angle(u1, w1)\ \theta_5=\angle(u2, w1)$$

$$\theta_2=\angle(u1, w2)\ \theta_6=\angle(u2, w2)$$

$$\theta_3=\angle(u1, w3)\ \theta_7=\angle(u2, w3)$$

$$\theta_4=\angle(u1, w4)\ \theta_8=\angle(u2, w4).$$

For calculating the subspace angle between the eigenvectors of the covariance matrix COV and the space spanned by the downmix matrix $D_U$, $\Theta$ is computed between every eigenvector and the columns of the downmix matrix $D_U$. In the above example, this leads to the following angles:

$$\theta_a=\min(\theta_1, \theta_5)\ \theta_c=\min(\theta_3, \theta_7)$$

$$\theta_b=\min(\theta_2, \theta_6)\ \theta_d=\min(\theta_4, \theta_8)$$

The eigenvectors of the covariance matrix COV are sorted by decreasing subspace angle, where those having the larger angles are preferably selected for defining the downmix matrix extension $D_W$. For example, in the case $\Theta_c>\Theta_a>\Theta_b>\Theta_d$ at least the eigenvector w3 associated with the angles $\Theta_3$ and $\Theta_7$ will be selected as part of the downmix matrix extension $D_W$.

As already mentioned above, the above described embodiments of the audio signal downmixing apparatus 105 can be implemented as a component of an encoding apparatus 101 of the audio signal processing system 100 shown in FIG. 1. As already described above, the audio signal downmixing apparatus 105 of the encoding apparatus 101 receives as input the input audio signal comprising Q input audio signal channels 113.

As described in detail above, the audio signal downmixing apparatus 105 processes on the basis of the downmix matrix $D_U$ or, in an embodiment, the extended downmix matrix D the Q channels of the multichannel input audio signal 113 and provides M primary output channels 123 of the audio output signal and, in an embodiment, furthermore up to Q-M auxiliary output channels 125 of the audio output signal.

The encoding apparatus 101 further comprises an encoder A 119 and another encoder B 121. The encoder A 119 receives as an input the M primary output channels 123 provided by the audio signal downmixing apparatus 105. The other encoder B 121 receives as an input from zero up to Q-M auxiliary output channels 125 provided by the audio signal downmixing apparatus 105.

The encoder A 119 is configured to encode the M primary output channels 123 provided by the audio signal downmixing apparatus 105 into a first bit stream 127. The other encoder B 121 is configured to encode the up to Q-M auxiliary output channels 125 provided, in an embodiment, by the audio signal downmixing apparatus 105 into a second bit stream 129. In an embodiment, the encoder A 119 and the other encoder B 121 can be implemented as a single encoder providing as an output a single bit stream.

The first bit stream 127 and the second bit stream 129 are provided as inputs to a decoding apparatus 103 of the audio signal processing system 100 shown in FIG. 1. The decoding apparatus 103 comprises corresponding decoders, namely a decoder A 133 and another decoder B 143, for decoding the first bit stream 127 and the second bit stream 129, respectively.

The decoder A 133 is configured to decode the first bit stream 127 such that the M primary input channels 135 provided by the decoder A 133 as output correspond to the M primary output channels 123 provided by the audio signal downmixing apparatus 105, i.e. such that the M primary input channels 135 provided by the decoder A 133 as output are essentially identical to the M primary output channels 123 provided by the audio signal downmixing apparatus 105 or a degraded version thereof (in case of a lossy codec implemented in the encoder A 119 and the decoder A 133).

The other decoder B 143 is configured to decode the second bit stream 129 such that the up to Q-M auxiliary input channels 145 provided by the other decoder B 143 as output correspond to the up to Q-M auxiliary output channels 125 provided by the audio signal downmixing apparatus 105, i.e. such that the up to Q-M auxiliary input channels 145 provided by the other decoder B 143 as output are essentially identical to the up to Q-M auxiliary output channels 125 provided by the audio signal downmixing apparatus 105 or a degraded version thereof (in case of a lossy codec implemented in the other encoder B 121 and the other decoder B 143).

In the embodiment shown in FIG. 1, the decoding apparatus 103 comprises an audio signal upmixing apparatus 139. In an embodiment, the audio signal upmixing apparatus 139 and/or the componets thereof are configured to perform essentially the inverse operation of the audio signal processing apparatus 105 and or the components thereof to generate an output audio signal 149. To this end, the audio signal upmixing apparatus 139 can comprise an upmix matrix determiner 137, a processor 141 and an upmix matrix extension determiner 147. In an embodiment, the processor 141 essentially performs the inverse operations (by means of a generalized-inverse method, e.g., pseudo-inverse) of the processor 109 of the audio signal processing apparatus 105 of the encoding apparatus 101. In an embodiment, the upmix matrix determiner 137 could be configured to determine an upmix matrix on the basis of the eigenvectors of the Laplace-Beltrami operator L and, if applicable, on the basis of the eigenvectors of the covariance matrix COV. In an embodiment, any additional data that the audio signal upmixing apparatus 139 can use for generating the output audio signal, such as metadata, can be transmitted via a bit stream 131. For instance, in an embodiment the audio signal downmixing apparatus 105 can provide the eigenvectors of the Laplace-Beltrami operator and/or, if applicable, the eigenvectors of the covariance matrix COV via the bit stream 131 to the audio signal upmixing apparatus 139 of the decoding apparatus for generating the output audio signal 149. The bit stream 131 can be encoded. An additional signal processing tool, i.e., remix (e.g., panning and wave field synthesis), can be further applied to the output audio signal 149 to obtain the targeted desired output audio signal. As the person skilled in the art will appreciate, the M primary input channels 135 provided by the decoder A 133 represent the M primary input channels 135 and the up to Q-M auxiliary input channels 145 provided by the other decoder B 143 represent the up to Q-M auxiliary input channels 145 of the input audio signal processed by the audio signal upmixing apparatus 139.

Figure 2:
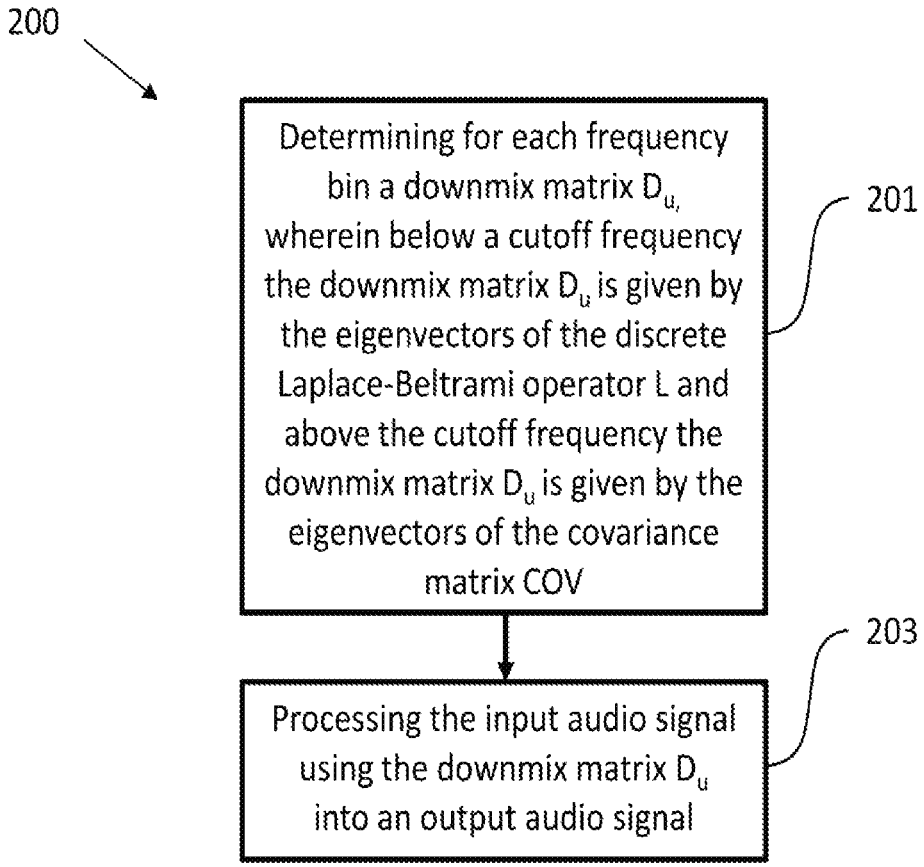
FIG. 2 shows a schematic diagram of an audio signal downmixing method according to an embodiment.

FIG. 2 shows a schematic diagram of an embodiment of an audio signal processing method 200 for processing an input audio signal into an output audio signal, wherein the input audio signal comprises a plurality of input channels 113 recorded at a plurality of spatial positions and the output audio signal comprises a plurality of primary output channels 123.

The audio signal processing method 200 comprises a step 201 of determining for each frequency bin j of a plurality of frequency bins a downmix matrix $D_U$ with j being an integer in the range from 1 to N, wherein for a given frequency bin j the downmix matrix $D_U$ maps a plurality of Fourier coefficients associated with the plurality of input channels 113 of the input audio signal into a plurality of Fourier coefficients of the primary output channels 123 of the output audio signal, wherein for frequency bins with j being smaller than or equal to a cutoff frequency bin k the downmix matrix $D_U$ is determined by determining eigenvectors of the discrete Laplace-Beltrami operator L defined by the plurality of spatial positions where the plurality of input channels 113 are recorded, and wherein for frequency bins with j being larger than the cutoff frequency bin k the downmix matrix $D_U$ is determined by determining a first subset of eigenvectors of a covariance matrix COV defined by the plurality of input channels 113 of the input audio signal.

Furthermore, the audio signal processing method 200 comprises a step 203 of processing the input audio signal using the downmix matrix $D_U$ into the output audio signal.

Embodiments of the invention may be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

What is claimed is:

1. An apparatus, comprising:

a downmix matrix determiner, configured to:

determine, for each frequency bin j of a plurality of frequency bins, a downmix matrix ($D_U$), with j being an integer in a range from 1 to N, wherein an input audio signal comprises a plurality of input channels recorded at a plurality of spatial positions, an output audio signal comprises a plurality of primary output channels, wherein, for a given frequency bin j, the downmix matrix ($D_U$) maps a plurality of Fourier coefficients associated with the plurality of input channels of the input audio signal into a plurality of Fourier coefficients of the plurality of primary output channels of the output audio signal, wherein, for frequency bins with j being smaller than or equal to a cutoff frequency bin k, the downmix matrix ($D_U$) is determined by determining eigenvectors of a discrete Laplace-Beltrami operator (L) defined by a plurality of spatial positions where the plurality of input channels are recorded, and wherein, for frequency bins with j being larger than the cutoff frequency bin k, the downmix matrix ($D_U$) is determined by determining a first subset of eigenvectors of a covariance matrix (COV) defined by the plurality of input channels of the input audio signal; and a processor, configured to process the input audio signal using the downmix matrix ($D_U$) into the output audio signal.

2. The apparatus of claim 1, wherein the downmix matrix determiner is configured to determine the discrete Laplace-Beltrami operator (L) using the following equations:

$$L = C - W$$

$$C = \mathrm{diag}\{c\}$$

$$c = [c_1, \ldots, c_p, \ldots, c_Q]$$

$$c_p = \Sigma_{q=1}^{Q} w_{pq};$$

where L, C and W are matrices having respective dimensions Q×Q, where Q is a number of input channels, diag ( . . . ) denotes a matrix diagonalization operation placing input vector elements as a diagonal of an output matrix with the rest of matrix elements being zero, c is a vector of dimension Q and $w_{pq}$ are local averaging coefficients.

3. The apparatus of claim 2, wherein the downmix matrix determiner is configured to determine the local averaging coefficients $w_{pq}$ using the following equations:

$$w_{pq} = \frac{1}{\|r_q - r_p\|^2};\ p \neq q$$

$$w_{pq} = 0;\ p = q,$$

where $r_p$ or $r_q$ is a vector defining a spatial position of the plurality of spatial positions where the plurality of input channels of the input audio signal are recorded.

4. The apparatus of claim 1, wherein, for frequency bins with j being smaller than or equal to the cutoff frequency bin k, the downmix matrix ($D_U$) is determined by selecting the eigenvectors of the discrete Laplace-Beltrami operator (L) that have an eigenvalue that is greater than a predefined threshold.

5. The apparatus of claim 1, wherein, for frequency bins with j being larger than the cutoff frequency bin k, the downmix matrix ($D_U$) is determined by selecting the eigenvectors of the covariance matrix (COV) that have an eigenvalue that is greater than a predefined threshold.

6. The apparatus of claim 1, wherein the downmix matrix determiner is configured to determine the cutoff frequency bin k by determining the frequency bin of the plurality of frequency bins which has the smallest compactness measure $\Theta_C$ of all frequency bins having a compactness measure $\Theta_C$ greater than a predefined threshold T, wherein a compactness measure $\Theta_C$ of a frequency bin is determined using the following equation:

$$\theta_C = \frac{\|\mathrm{diag}(\hat{U}^H \mathrm{COV} \hat{U})\|_F}{\|\mathrm{off}(\hat{U}^H \mathrm{COV} \hat{U})\|_F}$$

wherein $\hat{U}$ denotes a unitary matrix containing selected eigenvectors of the discrete Laplace-Beltrami operator (L), $\hat{U}^H$ denotes the hermitian transpose of $\hat{U}$, diag ( . . . ) denotes a matrix diagonalization operation zeroing all coefficients except the coefficients along the diagonal of the matrix given a matrix input, off ( . . . ) denotes a matrix operation zeroing all coefficients on the diagonal of the matrix and $\|. . .\|_F$ denotes the Frobenius norm.

7. The apparatus of claim 1, wherein the apparatus further comprises a downmix matrix extension determiner, configured to determine a downmix matrix extension ($D_W$) by determining a second subset of eigenvectors of the covariance matrix (COV) containing at least one eigenvector of the covariance matrix (COV) for providing at least one auxiliary output channel of the output audio signal, wherein the first subset of eigenvectors of the covariance matrix (COV) and the second subset of eigenvectors of the covariance matrix (COV) are disjoint sets and wherein the downmix matrix ($D_U$) and the downmix matrix extension ($D_W$) define an extended downmix matrix (D).

8. The apparatus of claim 7, wherein the downmix matrix extension determiner is configured to determine the second subset of eigenvectors of the covariance matrix (COV) by:

determining, for each eigenvector of the covariance matrix (COV), a plurality of angles between the eigenvector and a plurality of vectors defined by columns of the downmix matrix ($D_U$);

determining, for each eigenvector, the smallest angle of the plurality of angles between the eigenvector and the plurality of vectors defined by the columns of the downmix matrix ($D_U$); and selecting those eigenvectors of the covariance matrix (COV) for which the smallest angle between the eigenvector and the plurality of vectors defined by the columns of the downmix matrix ($D_U$) is bigger than a threshold angle $\Theta_{MIN}$.

9. The apparatus of claim 1, wherein the processor is configured to process the input audio signal for each of the plurality of input channels in a form of a plurality of input audio signal time frames, and wherein the plurality of Fourier coefficients associated with the plurality of input channels of the input audio signal are obtained by discrete Fourier transforms of the plurality of input audio signal time frames.

10. The apparatus of claim 9, wherein the downmix matrix determiner is configured to determine the covariance matrix (COV) defined by the plurality of input channels of the input audio signal by determining coefficients $c_{xy}$ of the covariance matrix (COV) for a given input audio signal time frame n of the plurality of input audio signal time frames and for the given frequency bin j of the plurality of frequency bins using the following equation:

$$c_{xy}(n,j)=E\{j_x \cdot j_y^*\}$$

where E{} denotes an expectation operator, $j_x$ denotes a Fourier coefficient at frequency bin j for input channel x of the input audio signal, * denotes the complex conjugate and x and y range from 1 to a number of input channels Q.

11. The apparatus of claim 9, wherein the downmix matrix determiner is configured to determine the covariance matrix (COV) defined by the plurality of input channels of the input audio signal by determining coefficients $c_{xy}$ of the covariance matrix (COV) for a given input audio signal time frame n of the plurality of input audio signal time frames and for the given frequency bin j of the plurality of frequency bins using the following equation:

$$c_{xy}(n,j)=\beta \cdot c_{xy}(n-1,j)+(1-\beta) \cdot \hat{c}_{xy}(n,j)$$

where β denotes a forgetting factor with $0 \leq \beta < 1$, $\hat{c}_{xy}(n,j)$ denotes the real part of $E\{j_x \cdot j_y^*\}$, $j_x$ denotes a Fourier coefficient at frequency bin j for input channel x of the input audio signal, * denotes the complex conjugate and x and y range from 1 to the number of input channels Q.

12. A method, comprising:

determining, for each frequency bin j of a plurality of frequency bins, a downmix matrix ($D_U$), wherein j is an integer in a range from 1 to N, wherein an input audio signal comprises a plurality of input channels recorded at a plurality of spatial positions, an output audio signal comprises a plurality of primary output channels, wherein, for a given frequency bin j, the downmix matrix ($D_U$) maps a plurality of Fourier coefficients associated with the plurality of input channels of the input audio signal into a plurality of Fourier coefficients of the primary output channels of the output audio signal, wherein, for frequency bins with j being smaller than or equal to a cutoff frequency bin k, the downmix matrix ($D_U$) is determined by determining eigenvectors of a discrete Laplace-Beltrami operator (L) defined by the plurality of spatial positions where the plurality of input channels are recorded, and wherein, for frequency bins with j being larger than the cutoff frequency bin k, the downmix matrix ($D_U$) is determined by determining a first subset of eigenvectors of a covariance matrix (COV) defined by the plurality of input channels of the input audio signal; and processing the input audio signal using the downmix matrix ($D_U$) into the output audio signal.

13. An apparatus, comprising:

a non-transitory memory; and a program code stored on the non-transitory memory, wherein the program code, when executed on a computer causes the computer to:

determine, for each frequency bin j of a plurality of frequency bins, a downmix matrix ($D_U$), wherein j is an integer in a range from 1 to N, wherein an input audio signal comprises a plurality of input channels recorded at a plurality of spatial positions, an output audio signal comprises a plurality of primary output channels, wherein, for a given frequency bin j, the downmix matrix ($D_U$) maps a plurality of Fourier coefficients associated with the plurality of input channels of the input audio signal into a plurality of Fourier coefficients of the primary output channels of the output audio signal, wherein, for frequency bins with j being smaller than or equal to a cutoff frequency bin k, the downmix matrix ($D_U$) is determined by determining eigenvectors of a discrete Laplace-Beltrami operator (L) defined by the plurality of spatial positions where the plurality of input channels are recorded, and wherein, for frequency bins with j being larger than the cutoff frequency bin k, the downmix matrix ($D_U$) is determined by determining a first subset of eigenvectors of a covariance matrix (COV) defined by the plurality of input channels of the input audio signal; and processing the input audio signal using the downmix matrix ($D_U$) into the output audio signal.

* * * * *